US010401800B2

(12) United States Patent
Cardinali et al.

(10) Patent No.: US 10,401,800 B2
(45) **Date of Patent: *Sep. 3, 2019**

(54) INDICATORS FOR WEARABLE ELECTRONIC DEVICES

(71) Applicant: Apple Inc., Cupertino, CA (US)

(72) Inventors: Steven P. Cardinali, Campbell, CA (US); Katherine E. Tong, San Francisco, CA (US); Trevor J. Ness, Santa Cruz, CA (US); William C. Lukens, San Francisco, CA (US)

(73) Assignee: APPLE INC., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/151,199

(22) Filed: Oct. 3, 2018

(65) Prior Publication Data

US 2019/0086875 A1 Mar. 21, 2019

Related U.S. Application Data

(63) Continuation of application No. 15/249,516, filed on Aug. 29, 2016, now Pat. No. 10,108,151.

(60) Provisional application No. 62/221,237, filed on Sep. 21, 2015.

(51) Int. Cl.

| | |
|---|---|
| ***G04G 21/02*** | (2010.01) |
| ***G04G 21/00*** | (2010.01) |
| ***G04G 9/00*** | (2006.01) |

(52) U.S. Cl.
CPC ..... *G04G 21/00* (2013.01); *G04G 9/0064* (2013.01); *G04G 21/025* (2013.01)

(58) Field of Classification Search
USPC ..... 340/539.1–539.32
See application file for complete search history.

(56) References Cited

U.S. PATENT DOCUMENTS

| | | | | |
|---|---|---|---|---|
| 10,108,151 | B2 * | 10/2018 | Cardinali | G04G 21/00 |
| 2001/0043514 | A1 * | 11/2001 | Kita | A44C 5/0015 368/281 |
| 2014/0180595 | A1 * | 6/2014 | Brumback | A61B 5/0015 702/19 |
| 2016/0066826 | A1 * | 3/2016 | Larvenz | A61B 5/14532 600/365 |

* cited by examiner

*Primary Examiner* — Muhammad N Edun
*Assistant Examiner* — Jerold B Murphy
(74) *Attorney, Agent, or Firm* — Morgan, Lewis & Bockius LLP

(57) ABSTRACT

A wearable electronic device includes a housing and a band attached to the housing. The band has an indicator with a variably and/or progressively illuminable portion. The indicator of the band conveys to a user an analog representation of the completion progress of an activity or task tracked by wearable electronic device. The wearable electronic device also includes a processing unit within the housing, and a sensor operatively coupled to the processing unit. In some cases, the sensor is a motion sensor such as an accelerometer or a gyroscope. In other examples, the sensor is a health sensor or a biometric sensor. Sensor data is used to update the indicator.

20 Claims, 9 Drawing Sheets

INDICATORS FOR WEARABLE ELECTRONIC DEVICES

CROSS-REFERENCE TO RELATED APPLICATION(S)

This application is a continuation of U.S. patent application Ser. No. 15/249,516, filed Aug. 29, 2016, which claims the benefit of U.S. Patent Application No. 62/221,237, filed Sep. 21, 2015 and titled "Indicators for Wearable Electronic Devices," the disclosures of which are hereby incorporated herein by reference in their entireties.

FIELD

Embodiments described herein are directed to status indicators for computing systems and, more particularly, to indicators for wearable electronic devices.

BACKGROUND

An electronic device can include an indicator to convey information to a user. Example indicators include an analog display, a digital display, or a status light. An indicator is typically viewable from a top side or a front face of the electronic device.

However, in many cases, the information conveyed to a user by an indicator is confidential or private information that the user may not prefer to be readily viewable or understandable to persons nearby. Further, certain electronic devices such as wearable electronic devices may be generally more readily viewable to persons nearby while also incorporating indicators intended to convey especially private health, medical, or fitness information.

SUMMARY

Embodiments described herein generally reference a wearable electronic device including a housing and a band attached to the housing with a variably illuminable portion. The variably illuminable portion of the band conveys to a user as an analog representation of the completion progress of an activity tracked by wearable electronic device. The wearable electronic device also includes a processing unit within the housing, and a sensor operatively coupled to the processing unit. In some cases, the sensor is a motion sensor such as an accelerometer or a gyroscope. In other examples, the sensor is a health sensor or a biometric sensor.

The wearable electronic device also includes a memory operatively coupled to the processing unit. The memory is configured to store executable instructions for obtaining sensor input from the sensor, computing a progress value based on the sensor input, and dynamically updating a lit section and/or an illumination state of the illuminable portion based on the progress value.

The illuminable portion can take different shapes for different embodiments such as a circular shape, an annular shape, a linear shape, or any arbitrary shape. In some cases, the illuminable portion is formed into a top surface of the band, a sidewall of the band, or a bottom surface of the band.

In one example, the illuminable portion itself includes a number of independently addressable light emitting elements such as a number of light-emitting diodes. In other cases, the illuminable portion is a variably and/or progressively illuminable light guide optically coupled to a light emitting element within the housing of the electronic device. When the light emitting element increases in brightness, sequential portions of the light guide illuminate.

Other embodiments described herein generally reference methods of progressively illuminating a band configured to couple a wearable electronic device to a user. Such methods include the operations of obtaining sensor input(s) from one or more sensors, computing a progress value based, at least in part, on the sensor input(s), and dynamically updating a lit section and/or an illumination state of the illuminable portion based on the progress value.

BRIEF DESCRIPTION OF THE FIGURES

Reference will now be made to representative embodiments illustrated in the accompanying figures. It should be understood that the following descriptions are not intended to limit the embodiments to one preferred embodiment. To the contrary, it is intended to cover alternatives, modifications, and equivalents as may be included within the spirit and scope of the described embodiments as defined by the appended claims.

The use of the same or similar reference numerals in different figures indicates similar, related, or identical items.

Figure 1A:
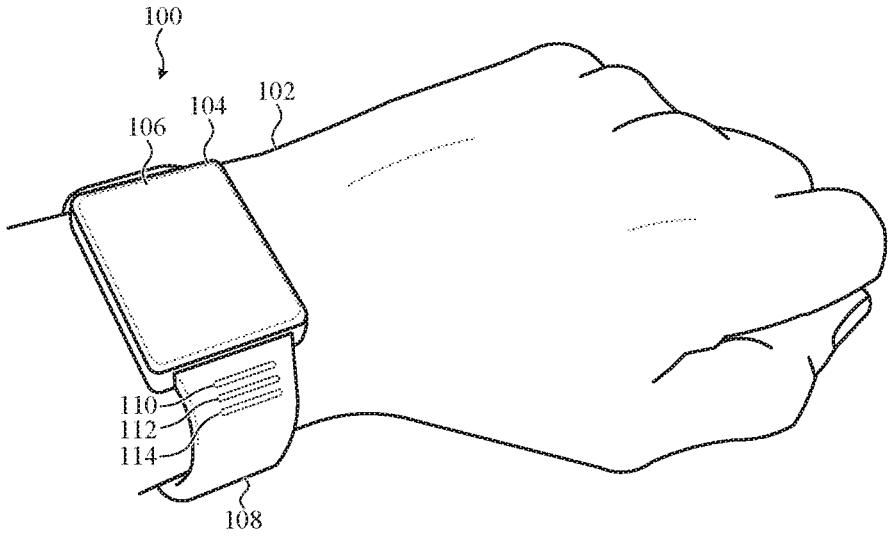
FIG. 1A depicts a wearable electronic device incorporating indicators configured to privately or discreetly convey information to a user.

The use of cross-hatching or shading in the accompanying figures is generally provided to clarify the boundaries between adjacent elements and also to facilitate legibility of the figures. Accordingly, neither the presence nor the absence of cross-hatching or shading conveys or indicates any preference or requirement for particular materials, material properties, element proportions, element dimensions, commonalities of similarly illustrated elements, or any other characteristic, attribute, or property for any element illustrated in the accompanying figures.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various embodiments described herein and, accordingly, may not necessarily be presented or illustrated to scale, and are not intended to indicate any preference or requirement for an illustrated embodiment to the exclusion of embodiments described with reference thereto.

DETAILED DESCRIPTION

Embodiments described herein generally reference a wearable electronic device that incorporates one or more indicators configured to convey informal, personal, private, sensitive, confidential, or other information to a user in a manner that is not readily visible and/or understandable to persons nearby.

Information conveyed to a user by an indicator of a wearable electronic device (such as described herein) can include medical reminders, medical notifications, health information, health recommendations, activity information, biometric information, physiological information, and so on. Such information may relate to the wearer of the electronic device or to another person.

In other examples, an indicator, as described herein, conveys information about the progress or status of an activity monitored by or performed by the wearable electronic device such as: a percentage completion of a local or remote file download; a remaining local or remote playback time of a media file; a remaining distance to a destination; a remaining capacity of a local or remote battery; a number or percent of unread, unwatched, or unheard messages; and so on. Such information may relate to the wearer of the electronic device, the wearable electronic device itself, or to another electronic device in communication with the wearable electronic device.

Accordingly, and more generally, indicators described herein can be used in any suitable implementation-specific manner to notify, update, advise, recommend, or otherwise convey information to a user of the wearable electronic device, whether such information specifically relates to the user, another person or group of persons, a location, a business, a vehicle, another electronic device, an action or operation of the particular wearable electronic device, or any other suitable information subject of interest to a user.

Indicators, as described herein may be variably and/or progressively illuminable. A progressively illuminable indicator sequentially changes from one illumination state to another. As used herein, the phase "illumination state" refers generally to a state of an indicator or a progressively illuminable indicator such as, but not limited to: an on state, an off state, an animated state, a variable or fixed brightness state, a variable or fixed color state, a variable or fixed saturation state, or any other suitable state or combination of states.

Some progressively illuminable indicators may alter an illumination, illuminate additional or different parts of an indicator (or different indicators in sequence), and the like to provide a progression or sequence of illumination. That is, each change in illumination builds on, depends on, or otherwise relates to a prior state of illumination; the change in illumination (e.g., the progress of illumination) generally conveys information not just by the illumination of an indicator but also by the change/progression itself. For example, a bar, icon or the like that illuminates from one end to the other is progressively illuminable. Many, but not all, progressively illuminable indicators are sequential and/or have illumination states and/or other conditions (or changes in illumination states and/or other condition) that correspond to a sequence of data.

A variably illuminable indicator may illuminate or alter illumination states of different portions of an indicator, or different indicators, as needed to convey information and not necessarily as part of an overall progression. Thus, variably illuminable indicators may be non-sequential and/or indicative of data at a certain point as opposed to (or in addition to) a sequence of data. It should be appreciated that an indicator may be both variably and progressively illuminable. Further, some examples of variable illumination may be progressive illumination and vice versa.

Further, it may be appreciated that the operation(s) of illuminating and/or altering the illuminated portions of an indicator (or more than one indicator, cooperatively with one or more other indicators) can vary from embodiment to embodiment. Any such illumination may be considered an illumination state, just as any change to an illumination may be considered a change of an illumination state. As a non-limiting example, certain embodiments may: vary a brightness, color, hue, or saturation of one or more illuminated portions of one or more indicators; vary a texture or pattern of one or more illuminated portions of one or more indicators; vary a speed or framerate of an animation or video displayed by one or more illuminated portions of one or more indicators; and so on. In these embodiments, these and/or other illumination properties or illumination characteristics of one or more illuminated portions of one or more indicators can be varied linearly, in a pattern, as an animation, and so on. In some embodiments, adjacent indicators can be updated simultaneously or sequentially, and may be cooperatively illuminated such that each indicator displays a separate portion of a single image or pattern.

In one example, an indicator is included within a band that connects the wearable electronic device to the user. The indicator is configured to resemble an analog display, such as a dial, a completion ring, a gauge, a progress bar, and so on. In these examples, a user glances at the indicator and understands the information conveyed by the wearable electronic device without the need to interact with the electronic device, read or understand a display of the device, or expose sensitive or private information to persons nearby.

In some cases, an indicator is implemented as a number of independently illuminable areas. In one example, a track of individual light-emitting diodes is arranged along the length of a top surface of the band. In another example, an arc or ring of individual light-emitting diodes is disposed within a top surface of the band. The independently illuminable light-emitting diodes are progressively lit by the wearable electronic device so as to resemble an analog progress bar. For these and related embodiments, the proportion of the indicator that is illuminated is generally referred to herein as the "active section," the "lit section," or the "illuminated portion."

In some cases, each of the independently illuminable areas of a lit section of an indicator are configured to emit light at the same brightness, color, hue, and/or saturation, although such a configuration is not required. In other examples, the independently illuminable areas of a lit section of an indicator can be independently controlled so that the indicator shows a variety of colors, animations, patterns, and so on.

In other cases, an indicator is implemented as a number of independently controllable haptic actuators. In one example, a track of piezoelectric haptic actuators is arranged along the length of a top surface the band. In another example, a track of acoustic transducers configured to output ultrasonic vibrations is arranged along the length of a top surface of the band. The independently controllable haptic actuators are progressively expanded, vibrated, or contracted by the wearable electronic device. In still other cases, an indicator is implemented with more than one type of output.

In some cases, each of the haptic actuators of an active section of an indicator is configured to generate the same haptic response, although such a configuration is not required. In other examples, the haptic actuators of an active section of an indicator can be independently controlled to so that the indicator generates a variety of sensations, texture simulations, friction simulations, haptic patterns, and so on.

In some examples, an indicator can include multiple types of independently controllable elements. For example, in one embodiment, an indicator includes both haptic actuators and illuminable portions. Accordingly, although many embodiments described and depicted herein reference illuminable indicators, it is appreciated that the methods, systems, and apparatuses described with respect thereto equally apply to indicators implemented with haptic actuators, thermal elements, acoustic elements, and so on.

These and other embodiments are discussed below with reference to FIGS. 1A-8. However, one skilled in the art will readily appreciate that the detailed description provided herein with respect to these figures is for explanation only and should not be construed as limiting.

FIG. 1A depicts a wearable electronic device 100 incorporating indicators configured to convey information to a user. The wearable electronic device 100 includes a two-band attachment system for securing to a wrist of the user 102. In other examples, the wearable electronic device 100 may take a variety of form factors including wristbands, bracelets, jewelry, necklaces, pendants, lapel pins, ankle bracelets, and/or the like. Still other embodiments implement the wearable electronic device 100 differently. For example, the wearable electronic device can be a smart phone, a gaming device, a digital music player, a sports accessory device, a medical device, a device that provides time and/or weather information, a health assistant, a navigation assistant, and other types of electronic device suitable for attaching, at least partially, to the user 102.

In many examples, the wearable electronic device 100 is a wearable multifunction device including features such as time keeping, health monitoring, sports monitoring, medical monitoring, communications, navigation, computing, and/or the like.

The wearable electronic device 100 includes a housing 104 that carries, encloses, and supports the operational and/or functional components of the wearable electronic device 100. The housing 104 can form an outer surface or partial outer surface and protective case for the internal components of the wearable electronic device 100. In the illustrated embodiment, the housing 104 is formed into a substantially rectangular shape, although this configuration is not required. Examples of other operational or functional components that are carried, enclosed, and/or supported by the housing 104 include processing units, memory modules, displays, sensors, biosensors, wireless communication modules, speakers, microphones, haptic actuators, rotational input devices, buttons, biometric authentication sensors and systems, batteries, and so on.

The construction of the housing 104 may vary from embodiment to embodiment. For example, the housing 104 can be formed from a variety of materials including plastic, rubber, wood, silicone, glass, ceramic, fiber composite, metal or metal alloy (e.g., stainless steel, aluminum, and so on), precious metals (e.g., gold, silver, platinum, titanium, and so on), or other suitable materials, or a combination of these materials. The housing 104 can be formed of one or more components operably connected together, such as a front piece and a back piece, or a top and bottom clamshell. Alternatively, the housing 104 can be formed of a single piece (e.g., uniform body or unibody).

The wearable electronic device 100 includes a display 106. The display 106 can be implemented with any suitable technology, including, but not limited to, a multi-touch and/or multi-force sensing touchscreen that uses liquid crystal display technology, light emitting diode technology, organic light-emitting display technology, organic electroluminescence technology, electronic ink, flexible display technology, or another type of display technology or combination of display technology types. In many examples, the display 106 may also incorporate an input device configured to receive touch input, force input, rotation input, and the like from the user 102.

As noted above, the wearable electronic device 100 can be permanently or removably connected to a user via a band 108. The band 108 may be configured to attach to the housing 104 and provide a loop for securing to the wrist of the user 102. The band 108 can be integral with the housing 104 or it can be a separate part. If integral, the band 108 is a continuation of the housing 104. In some cases, the integral band is formed from the same material as the housing 104. If the band 108 is separate, the band is fixed or releasably coupled to the housing 104. In both cases, the band 108 may be formed from similar or different materials as the housing. In many embodiments, the band 108 is formed from a flexible material such that it can conform to the user's body.

In some cases, the band 108 is a single integral part whereas in others it may include attachment ends attached to opposite sidewalls of the housing 104. The attachment ends provide an open and closed configuration for the band 108. The attachment ends may, for example, include a clasp. This particular configuration allows the user 102 to open the band 108 for placement on the wrist and, thereafter, close the band 108 in order to secure the wearable electronic device 100 and the band 108 to the wrist. The band 108 may be formed from any number of suitable materials such as rubber, fluoroelastomer, silicone, leather, metal, woven fabric, mesh, links and/or the like.

As noted above, the wearable electronic device 100 also includes one or more indicators, such as the indicators 110, 112, and 114. Each of the indicators 110, 112, and 114 can be configured to convey information, either independently or collectively, to the user 102. For example, in one embodiment the indicator 110 provides different information than the indicator 112. In other examples, the indicator 114 can cooperate with the indicator 112. Although three separate indicators are shown, the wearable electronic device 100 and/or the band 108 can be implemented with any number of suitable indicators; one wearable electronic device can include a single indicator, whereas another wearable electronic device includes multiple indicators. The various indicators discussed herein may be considered illumination portions of an overall system or configuration. Likewise, each indicator may have its own distinct illuminable portions; such illuminable portions may be separately and uniquely illuminated, in certain embodiments.

In some cases, the indicators 110, 112, and 114 are formed in the same shape, although this is not required. The indicators can be of the same type (e.g., illuminating indicator, haptic indicator, thermal indicator, and so on), although this is not required.

In FIG. 1A, the indicators 110, 112, and 114 are shown in phantom to indicate that when the indicators 110, 112, and 114 are not active and/or illuminated, the indicators 110, 112, and 114 may not be visible to the user 102. In other words, the indicators may be, at least partially, embedded within the band 108, for example, below a top surface thereof. However, such a configuration is not required of all embodiments. In other cases, the indicators extend at least partially proud of the top surface of the band 108. In other cases, the indicators are flush with a top surface of the band 108.

In one embodiment, one or more of the indicators is implemented as a number of independently illuminable areas (not shown). More particularly, the indicator is defined, in part, by a track of individual light-emitting or otherwise illuminable areas arranged along the width of the top surface of the band 108.

In some cases, the band 108 may be formed from an optically transparent or optically translucent material.

In one embodiment, the illuminable areas of one or more of the indicators 110, 112, and 114 are implemented as a series of addressable light-emitting diodes. The wearable electronic device 100 progressively illuminates the light-emitting diodes so as to resemble an analog progress bar that visually communicates to the user 102 the completion status of a task or activity monitored by the wearable electronic device 100.

In these embodiments, the light-emitting diodes are positioned closely adjacent to one another such that no gaps in the lit portion of the indicator(s) are apparent to the user 102. In some cases, the light-emitting diodes are positioned less than 1 mm from one another. In other embodiments, the light-emitting diodes are positioned less than 3 mm from one another.

In other embodiments, one or more of the indicators 110, 112, and 114 are implemented with one or more variably and/or progressively illuminable electroluminescent wires. The wearable electronic device 100 progressively illuminates the electroluminescent wire so as to resemble an analog progress bar.

In other embodiments, one or more of the indicators 110, 112, and 114 are implemented using liquid crystal technology, organic light-emitting diode technology, organic electroluminescence technology, electronic ink technology, flexible display technology, or another type of visualization technology or combination of visualization technology types. In these examples, the wearable electronic device 100 progressively illuminates portions of the indicator so as to resemble an analog progress bar.

In some embodiments, the wearable electronic device 100 can illuminate a first portion of the indicator 110 in a first manner and a second portion of the indicator 110 in a second manner. For example, the first portion may be illuminated red and the second portion may be illuminated blue. Other embodiments can select different colors. In another example, the first portion may be illuminated brightly whereas the second may be dimly illuminated. In some cases, an indicator such as the indicator 110 can be animated.

Figure 1B:
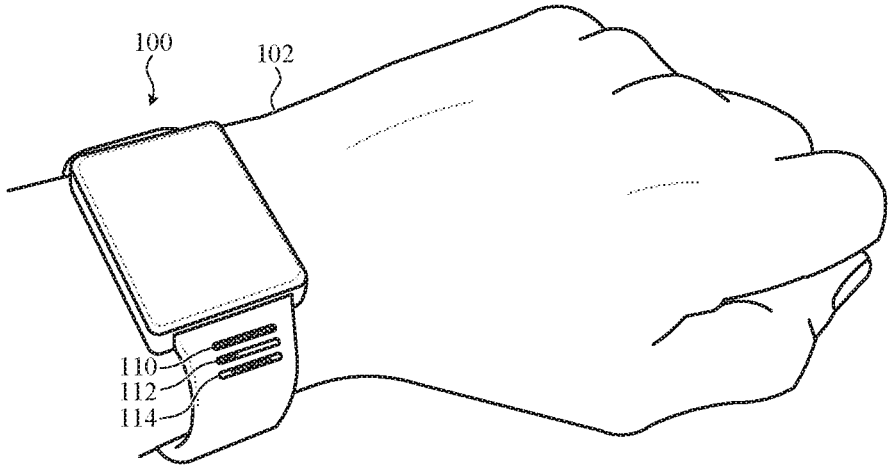
FIG. 1B depicts the wearable electronic device of FIG. 1A, showing partial illumination of the indicators.

In some embodiments, the wearable electronic device 100 can illuminate an interior portion of the indicator in a first manner and an exterior portion of the indicator in a second manner, such as the indicator 114 is illustrated in FIG. 1B. In these examples, the lit portion of an indicator can gain width from a centerline toward an edge of the indicator to convey information to a user. In other examples, the lit portion can progress from one edge of the indicator to the other edge of the indicator to convey information to a user.

As noted with respect to other embodiments described herein, the wearable electronic device 100 may utilize the indicators 110, 112, 114 to convey informal, personal, private, sensitive, confidential or other information to the user 102 in a manner that is not readily visible and/or understandable to persons nearby. For example, the user 102 may instruct the wearable electronic device 100 to track the user 102's progress toward a particular fitness goal with the indicator 110. In one example, the wearable electronic device 100 can track the number of steps the user 102 takes in a day. Over the course of the day as the user 102 continues to step, the wearable electronic device 100 progressively updates (e.g., increases) the lit section of the indicator 110 until the indicator 110 is completely illuminated (see, e.g., FIG. 1B). The user 102 understands that a fully illuminated indicator 110 signifies that the user 102 has attained the daily step goal.

However, because the subject associated with each of the indicators 110, 112, and 114 is known only to the user 102, persons nearby the user 102 may not readily understand what the lit section of a particular indicator signifies. In other words, the wearable electronic device 100 conveys information to the user 102 via the indicators using a vocabulary only the user 102 understands, thereby preserving the user's privacy without detracting from the convenience and accessibility of the wearable electronic device 100.

In further embodiments, one or more of the indicators 110, 112, and 114 can be customized by the user 102 to convey information in a particular manner. For example, the user 102 can customize the shape, color, brightness, direction, duration of activation, pattern, and so on of the indicators 110, 112, and 114. In other words, the wearable electronic device 100 conveys information to the user 102 via the indicators using a vocabulary the user 102 defines.

Accordingly, the wearable electronic device 100, among other electronic devices described herein, may be used in many embodiments to convey private, personal, and/or confidential information. For example, the wearable electronic device 100 can use the indicators 110, 112, 114 to convey medical reminders, medical notifications, health information, health recommendations, activity information, biometric information, physiological information, and so on. Such information may relate to the wearer of the electronic device or to another person. For example, the user 102 may be a parent. Such a user may configure the wearable electronic device 100 to display a child's activity over the course of the day via one or more of the indicators 110, 112, 114. For example, the parent's wearable electronic device may receive information about the child's activity via one or more wired or wireless communication channels, thereafter updating the lit portion of one or more indicators corresponding to that activity.

In another example, a caretaker may use the wearable electronic device 100 to monitor medical or health information of a patient. In one example, the caretaker's wearable electronic device reports the amount of time elapsed since the patient last took a dosage of a prescription medication. In another example, the caretaker's wearable electronic device updates the lit section of the indicator in response to respiration, circulation, or another physiological characteristic of the patient. The caretaker's wearable electronic device may receive information about the patient's activity via one or more wired or wireless communication channels, thereafter updating the lit portion of one or more indicators corresponding to that activity.

In other examples, an indicator as described herein conveys information about the progress or status of an activity monitored by or performed by the wearable electronic device 100 such as a percent completion of a local or remote file download, a remaining local or remote playback time of a media file, a remaining distance to a destination, a remaining capacity of a local or remote battery, a number or percent of unread, unwatched, or unheard messages, and so on. Such information may relate to the user 102, the wearable electronic device 100, or to another electronic device (not shown) in communication with the wearable electronic device 100.

For example, in one implementation the wearable electronic device 100 utilizes the indicator 110 to communicate the user 102's progress toward a health-related goal (e.g., minimum number of steps within a day, hours in which the user 102 stood, cumulative movement of the user 102, and so on). For example, the wearable electronic device 100 can increase the brightness or change the color of the indicator 110 as the user 102 approaches completion of the goal. The wearable electronic device 100 can flash the indicator 110 if the user 102 is at risk of not completing the goal (e.g., less than a certain percent completion of the goal at a particular time of day). The wearable electronic device 100 can change the color of the indicator 110 when the user 102 exceeds a goal. In some embodiments, the wearable electronic device 100 progressively illuminates the indicator 110 as the user 102 progresses toward the goal; when the indicator 110 is entirely illuminated, the user 102 understands that the user has obtained the health-related goal. Particularly, FIG. 1B illustrates the indicator 110 as fully illuminated.

In another embodiment, the wearable electronic device 100 utilizes the indicator 110 to remind the user to perform a health-related task, such as a reminder to take prescription medication. The wearable electronic device 100 progressively illuminates the indicator 110 as the time or date prescribed to perform the health-related task approaches; when the indicator 110 is entirely illuminated, the user 102 understands that the health-related task is due to be performed.

In another embodiment, the wearable electronic device 100 utilizes the indicator 110 to inform the user of health, medical, or physiological status of the user (e.g., fertility, blood glucose, ultraviolet exposure, and so on). As with other embodiments described herein, the wearable electronic device 100 illuminates the indicator 110 (and/or the indicators 112, 114) to communicate the associated health, medical, or physiological status of the user.

In some cases, the indicators 110, 112, 114 are persistently activated (e.g., illuminated) and updated. In other words, the present status of the indicators 110, 112, 114 is constantly shown throughout the day; updates to the indicators 110, 112, 114 from the wearable electronic device are updated in real time, or substantially real time.

In other cases, the indicators 110, 112, 114 are illuminated only in response to a signal from the wearable electronic device 100 and/or the user 102. For example, one or more of the indicators 110, 112, 114 can be illuminated when the wearable electronic device 100 detects that the user 102 has raised his or her wrist. In another example, one or more of the indicators 110, 112, 114 can be illuminated when the user 102 presses a button or a display of the wearable electronic device 100. In another example, one or more of the indicators 110, 112, 114 can be illuminated when the user 102 presses a button associated with the band 108.

In some cases, the wearable electronic device 100 and/or the user 102 can customize the output of the indicators 110, 112, and 114. For example, a rotational input device of the wearable electronic device 100 can be used to temporarily dim or brighten the output of the indicators 110, 112, and 114.

Figure 2A:
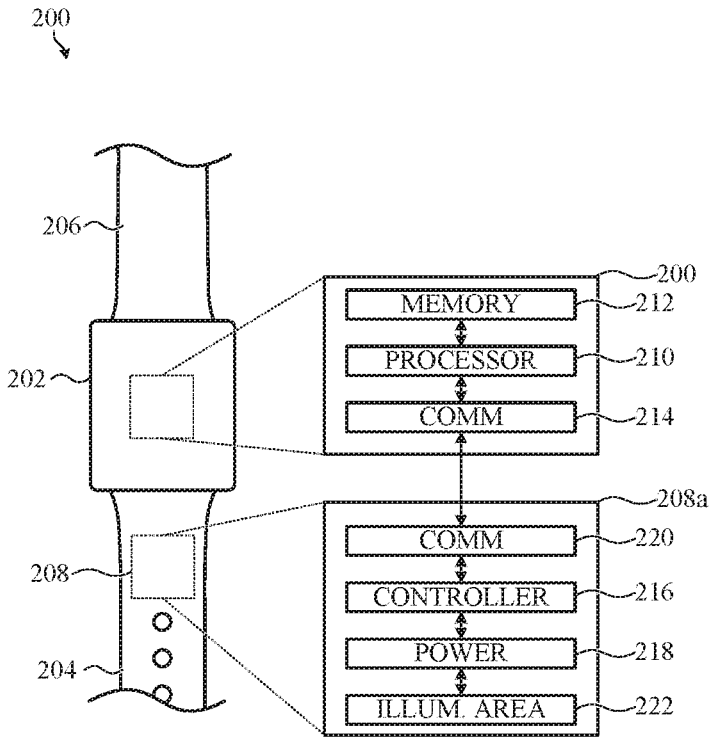
FIG. 2A depicts a simplified system diagram of a wearable electronic device coupled to a band incorporating an active indicator in communication with the wearable electronic device.
Figure 2B:
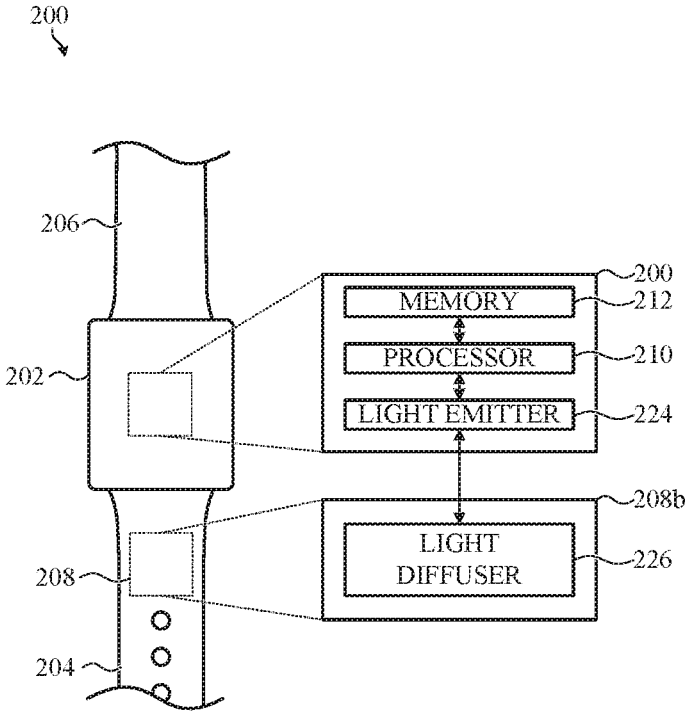
FIG. 2B depicts a simplified system diagram of another wearable electronic device coupled to a band incorporating a passive indicator optically coupled to the wearable electronic device.
Figure 2C:
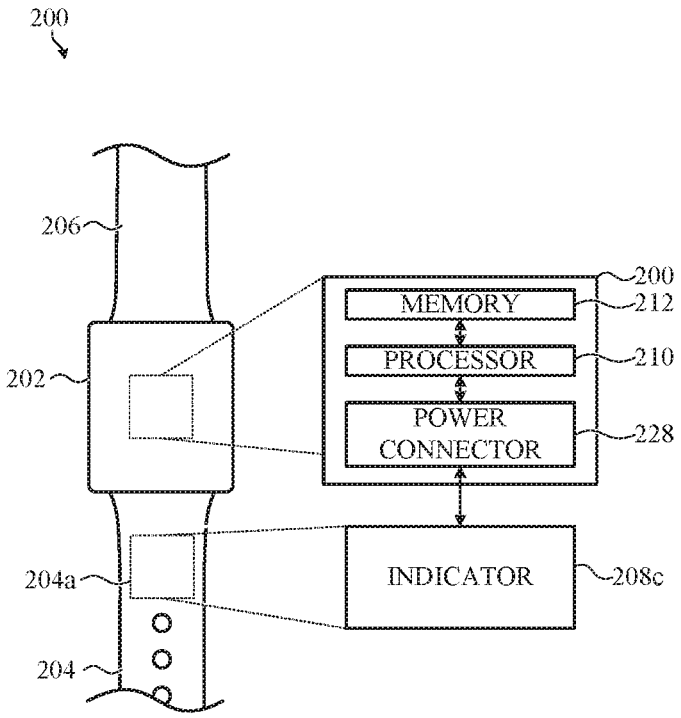
FIG. 2C depicts a simplified system diagram of yet another wearable electronic device coupled to a band incorporating an indicator powered by the wearable electronic device.

FIGS. 2A-2C generally depict simplified system diagrams of example embodiments of a wearable electronic device (such as the wearable electronic device 100 depicted in FIGS. 1A-1B) coupled to a band incorporating one or more indicators. These embodiments are described with respect to the generalized interoperation of an indicator and a wearable electronic device; it is understood that the embodiments that follow, and modifications thereof, can each be used in any suitable implementation-specific manner to notify, update, advise, recommend, or otherwise convey information to a user of the wearable electronic device, whether such information specifically relates to the user, another person or group of persons, a location, a business, a vehicle, another electronic device, or any other suitable information subject of interest to a user.

Furthermore, as noted above, although many embodiments described below reference illuminable indicators, it is appreciated that the methods, systems, and apparatuses described with respect thereto equally apply to indicators implemented with haptic actuators, thermal elements, acoustic elements, or any combination thereof.

Indicators incorporated within bands of wearable electronic devices can be self-powered, passive, or can be powered by the wearable electronic device to which the band is coupled.

For example, FIG. 2A generally depicts an example system diagram of a wearable electronic device coupled to a band incorporating an indicator that is implemented as a discrete and self-powered electronic device embedded within the band. The wearable electronic device communicates with the indicator via a communication channel, and the indicator updates itself accordingly to convey new or different information to the user. In some cases, the communication channel is a two-way communication channel, but this is not required. In this embodiment, the indicator is self-powered, incorporating a power source separate from the wearable electronic device. Thus, the operation (e.g., illumination) of the indicator does not negatively affect the battery life of the wearable electronic device.

Alternatively, FIG. 2B generally depicts an example embodiment of a wearable electronic device coupled to a band incorporating an indicator that is implemented as a passive light diffusing and/or emitting area within the band. The wearable electronic device includes a light emitting element that illuminates the indicator within the band via an optical coupling (e.g., fiber optic cable) between the indicator and the light emitting element. The wearable electronic device varies the brightness, color, hue, saturation, or another visual property of the light emitting element (and thus the indicator) to convey new or different information to the user. In this embodiment, the indicator is passive and does not, itself, draw power. Thus, a band with a passive indicator may be inexpensively manufactured and may be readily swapped or replaced without the need to re-establish communication with the wearable electronic device.

In yet other embodiments, such as the embodiment depicted in FIG. 2C, a wearable electronic device can couple to a band incorporating an indicator that draws power from the wearable electronic device. The wearable electronic device communicates with the indicator via a communication channel or via the power coupling and the indicator updates accordingly to convey new or different information.

Further embodiments can incorporate more than one type of indicator. For example, a band can incorporate a self-powered indicator in addition to a passive indicator.

Each of the embodiments depicted in FIGS. 2A-2C depict a wearable electronic device 200 including a housing 202 that carries, encloses, and supports the operational and/or functional components of the wearable electronic device 200. The housing 202 is coupled to a two-part band system that includes a first band portion 204 and a second band portion 206. As noted with respect to other embodiments described herein, the first and second band portions are configured to join with one another to form a closed loop around the wrist of a user, such as shown in FIG. 1A.

An indicator 208 is included within the first band portion 204. The indicator can be self-powered such as the indicator 208*a* shown in FIG. 2A, passive such as the indicator 208*b* shown in FIG. 2B, or powered by the wearable electronic device such as the indicator 208*c* shown in FIG. 2C.

When attached to the wrist of the user, the first band portion 204 is closer to the user's body than the second band portion 206. In this manner, the indicator 208 may be readily viewable to a user of the wearable electronic device 200 regardless of the user's hand or wrist position. In other embodiments, the indicator 208 can be disposed within the second band portion 206 in addition to or in place of the first band portion 204.

The indicator 208 may be, at least partially, embedded within the first band portion 204, below a top surface thereof. However, such a configuration is not required of all embodiments. In other cases, the indicator 208 extends at least partially proud of the top surface of the first band portion 204. In other cases, the indicator 208 is flush with a top surface of the first band portion 204. In still further examples, the indicator 208 is embedded within, extends proud of, or is flush with a sidewall of the first band portion 204. In other cases, the indicator 208 is embedded within, extends proud of, or is flush with a closure mechanism associated with the first band portion 204 and/or the second band portion 206. For example, as illustrated in FIGS. 2A-2C, the first band portion 204 joins with the second band portion 206 by inserting a pin of the second band portion 206 within an eyelet defined by the first band portion 204; the indicator 208 can be disposed, at least partially, within or around the pin. In some cases, the pin is optically coupled to the indicator 208 and can, itself, illuminate upon illumination of the indicator 208.

In other cases, the indicator 208 may circumscribe an area of a surface of the band. For example, the indicator 208 can be disposed to circumscribe a rectangular area of the band; when illuminated, the indicator 208 appears as a visual representation of an outline of the rectangular area. In other cases, other shapes such as circular shapes, square shapes, or arbitrary shapes can be used. In some examples, the indicator 208 circumscribes the perimeter of the band itself.

The wearable electronic device 200 depicted in FIGS. 2A-2C also includes a processor 210 that is configured to communicate with, control, or influence the indicator 208 in one of many ways. For example, as noted above, an indicator 208 may be a self-powered discrete electronic device such as shown in FIG. 2A, a passive device such as shown in FIG. 2B, or an electronic device powered by the wearable electronic device 200 such as shown in FIG. 2C. In each of these embodiments, the processor 210 may communicate with, control, or influence the indicator 208 in different ways, the details of which are described below.

For each of the embodiments depicted in FIGS. 2A-2C, the processor 210 is disposed within the housing 202. The processor 210 is configured to access a memory 212 having instructions stored therein. The instructions may be configured to cause the processor 210 to perform, coordinate, or monitor one or more of the operations or functions of the wearable electronic device 200.

For example, the instructions may be configured to control or coordinate the operation of a display, a force or touch input/output component, a communication module, one or more sensors, a speaker/microphone, a biometric sensor, a biometric authentication module, and/or one or more haptic feedback devices. For simplicity of illustration and to reduce duplication of elements between figures, many of these (and other) components are omitted from one or more of the simplified diagrams depicted in FIGS. 2A-2C.

The processor 210 may be implemented as any electronic device or combination of electronic devices capable of processing, receiving, or transmitting data or instructions. For example, the processor 210 may include one or more of a microprocessor, a central processing unit, an application-specific integrated circuit, a digital signal processor, an analog circuit, or any other combinations of such devices. As described herein, the term "processor" is meant to encompass a single processor or processing unit, multiple processors, multiple processing units, or other suitably configured computing element(s).

The memory 212 can also store electronic data that can be used by the wearable electronic device 200. For example, the memory 212 can store electrical data or content such as media files, documents and applications, device settings and user preferences, timing and control signals or data for various modules, data structures or databases, and so on. The memory 212 can be configured as any type of memory. By way of example, the memory 212 can be implemented as random access memory, read-only memory, flash memory, removable memory, or other types of storage elements, or combinations of such devices.

A communication module 214 is coupled to the processor 210 and may include one or more wireless interface(s) that are adapted to facilitate communication between the processor 210 and a separate electronic device. In general, the communication module 214 may be a wireless interface configured to transmit and receive data and/or signals that may be interpreted by instructions executed by the processor 210. Example communication modules include: radio frequency interfaces, cellular interfaces, fiber optic interfaces, acoustic interfaces, Bluetooth interfaces, infrared interfaces, magnetic interfaces, electrical field interfaces, USB interfaces, Wi-Fi interfaces, Near-Field Communication interfaces, TCP/IP interfaces, network communications interfaces, or any other wireless communication interfaces.

In many embodiments, the communication module 214 of the wearable electronic device 200 of FIGS. 2A-2C is configured to obtain data from an external electronic device such as a server, cellular phone, tablet computer, laptop computer, electronic vehicle, or other such device. Data obtained by the communication module 214 can be used to adjust or update the indicator 208. As used herein, data obtained from an external electronic device is referred to as "external data." External data can include information related to other persons (e.g., health information, medical information, proximity information, location information, and so on), groups of persons (e.g., family members, patient groups, and so on), to entities (e.g., stock prices of public corporations, operating hours of a business, and so on), to locations (e.g., weather, traffic, and so on), to personal or real property (e.g., charge status of an electronic car, fuel status of an internal combustion car, status of a home security system or sensor, battery capacity remaining within a separate electronic device, and so on), or to any other information external to the wearable electronic device 200 of interest to a user.

The wearable electronic device 200 of FIGS. 2A-2C may also include a battery (not shown) that is used to store and provide power to the other components of the wearable electronic device 200. The battery may be a rechargeable battery that is configured to provide power to the wearable electronic device 200 while it is being worn by the user. The wearable electronic device 200 may also be configured to recharge the battery using a wireless charging system. In some examples, the charging or discharging status of the battery can be used to adjust or update the indicator 208. As used herein, data related to the current charging or discharging status of the battery is referred to as "power data."

The wearable electronic device 200 of FIGS. 2A-2C also includes one or more sensors (not shown) which can be configured to detect environmental conditions and/or other aspects of the operating environment of the wearable electronic device 200. For example, an environmental sensor may be an ambient light sensor, proximity sensor, temperature sensor, barometric pressure sensor, moisture sensor, and the like. In some embodiments, such data may be used to adjust or update the indicator 208. In other cases, the sensors may be used to compute an ambient temperature, air pressure, and/or water ingress into the wearable electronic device 200. Such data may be used to adjust or update the indicator 208. As used herein, data obtained by the wearable electronic device 200 related to environmental conditions and/or other aspects of the operating environment of the wearable electronic device is referred to as "environmental data." Environmental data can include temperature data, humidity data, pressure data, condensation data, pollution data, allergen data, air quality data, and so on.

In still further embodiments, the sensors of the wearable electronic device 200 of FIGS. 2A-2C may include one or more motion sensors (e.g., accelerometer, gyroscope, global positioning sensor, tilt sensor, and so on) for detecting movement and acceleration of the wearable electronic device 200. Such data may be used to adjust or update the indicator 208. As used herein, data related to movement of the wearable electronic device is referred to as "movement data." Movement data can include acceleration, rotation, cardinal direction, velocity, displacement, distance, physical activity of a user, and so on.

The wearable electronic device 200 of FIGS. 2A-2C may also include one or more biosensors (not shown) that may be used to compute one or more health metrics of the user. An example biosensor is a photoplethysmographic sensor used to compute various health metrics, including: heart rate, respiration rate, blood oxygenation level, blood volume estimates, blood pressure, arterial pressure, or a combination thereof. The wearable electronic device 200 can use such data to adjust or update the indicator 208. As used herein, data related to the physiology of the user of the wearable electronic device is referred to as "physiological data."

Other biosensors can be configured to perform an electrical measurement to characterize electrocardiographic characteristics, galvanic skin response, or other electrical properties of a user's body. Additionally or alternatively, one or more of the biosensors may be configured to measure body temperature, exposure to UV radiation, and other health, medical, or physiological information. In some embodiments, such data may be used to adjust or update the indicator 208. As used herein, data obtained by the wearable electronic device 200 related to health of the user of the wearable electronic device is referred to as "health data." Health data can include medical information, health information, prescription information, fertility information, metabolism information, digestion information, stress information, radiation exposure information, and so on.

The wearable electronic device 200 of FIGS. 2A-2C may also include one or more utility sensors (not shown) that may be used to determine, quantify, or measure a property of an object. Example utility sensors include: magnetic field sensors, electric field sensors, color meters, acoustic impedance sensors, pH level sensor, material detection sensor, and so on. The wearable electronic device 200 can use such data to adjust or update the indicator 208. As used herein, data related to an object separate from the wearable electronic device is referred to as "utility data."

In many cases, the processor 210 can sample (or receive samples of) external data, motion data, power data, environmental data, physiological data, health data, utility data, and/or other data and track the progress thereof over a defined or undefined period of time. The cumulative tracked data, the rate of change of the tracked data, the average of the tracked data, the maximum of the tracked data, the minimum of the tracked data, the standard deviation of the tracked data, and so on, can all be used to adjust or update the indicator 208, regardless of whether the indicator 208 is self-powered, passive, or powered by the wearable electronic device.

In some embodiments, the processor 210 of the wearable electronic device depicted in FIGS. 2A-2C is configured to communicate directly with the indicator 208 via the communication module 214. With specific reference to the embodiment depicted in FIG. 2A, the communication module 214 establishes a wireless communication channel between the wearable electronic device 200 and the indicator 208 (identified in FIG. 2A as 208*a*), which is implemented as a discrete and self-powered electronic device. The discrete indicator 208*a* can be configured to convey information to the user in the same manner as described with respect to other embodiments herein. In this embodiment, information conveyed by the discrete indicator 208*a* is typically communicated via the wireless communication channel established by the communication module 214.

In the embodiment depicted in FIG. 2A, the discrete indicator 208*a* includes a controller 216. The controller 216 may be implemented as any electronic device or combination of electronic devices capable of processing, receiving, or transmitting data or instructions. For example, the controller 216 may be a processor including one or more of a microprocessor, a central processing unit, an application-specific integrated circuit, a digital signal processor, or combinations of such devices.

The controller 216 of FIG. 2A is coupled to or incorporates a memory (not shown) which can store electronic data that can be used by the discrete indicator 208*a* to convey information to the user. For example, the memory can store data related to different modes of the discrete indicator 208*a*. The memory can be configured as any type of memory such as random access memory, read-only memory, flash memory, removable memory, or other types of storage elements, or combinations of such devices.

The controller 216 of FIG. 2A is coupled to a power source 218. The power source 218 can be a battery, capacitor, or a series of batteries or capacitors. In these embodiments, the power source 218 can be recharged by connecting to an external power source. In some cases, the external power source may be the wearable electronic device 200 (see, e.g., FIG. 2C). In other cases, the power source 218 collects power from a different external source, such as a light source, audio source, or radio source. In some cases, the power source 218 may be a power generator configured to convert mechanical, thermal, or acoustic energy into usable energy for the indicator 208*a*. The power source 218 is embedded, at least partially, within the second band portion 206.

The controller 216 of FIG. 2A is also coupled to a communication module 220 that is configured to interface with the communication module 214 of the wearable electronic device 200. In general, the communication module 220 may be configured to transmit and receive data and/or signals that may be interpreted as instructions executed by the controller 216.

The discrete indicator 208*a* of FIG. 2A can be implemented as a number of independently illuminable areas 222, such as light-emitting diodes, partitioned electroluminescent wire, a series or array of electroluminescent polymer deposits, or electronic ink. In one embodiment, the independently illuminable areas are progressively lit by the wearable electronic device 200 so as to resemble an analog display such as a progress bar, dial, arc, or other analog display.

In some cases, each of the independently illuminable areas 222 of the discrete indicator 208*a* that are illuminated at a particular time (e.g., the "lit section") are configured to emit light at the same brightness, color, hue, and/or saturation although such a configuration is not required. In other examples, the independently illuminable areas 222 of a lit section of the discrete indicator 208*a* can be independently controlled so that the indicator shows a variety of colors, animations, patterns, and so on. Information related to the brightness, color, hue, and/or saturation of individual independently illuminable areas or groups of independently illuminable areas 222 can be communicated to the controller 216 from the wearable electronic device 200 via the communication modules 214, 220.

In one embodiment, the independently illuminable areas 222 of the discrete indicator 208*a* are a series of addressable light-emitting diodes. The wearable electronic device 200 instructs the discrete indicator 208*a*, via the communication channel between the communication modules 214, 220, to progressively illuminate the light-emitting diodes so as to resemble an analog progress bar that visually communicates to the user 102 external data, motion data, power data, environmental data, physiological data, health data, utility data, or any other data or statistical or temporal analysis thereof. In one example, the user understands a progress-bar-shaped indicator conveys information related to the user's total movement over the course of a day. Throughout the day, a motion sensor within the wearable electronic device conveys samples of motion data to the processor 210 which uses the samples to calculate the user's cumulative motion as of a particular time of day. Thereafter, the processor 210 communicates the cumulative motion data to the indicator, which increases the size of the lit section of the indicator in proportional response. At the beginning of the day, the indicator may not be illuminated at all. At the end of the day, should the user have moved a sufficient amount, the indicator may be fully illuminated.

In some embodiments, the processor 210 of the wearable electronic device shown in FIGS. 2A-2C is coupled to a light emitting element that illuminates a passive indicator within a band. For example, FIG. 2B depicts a simplified system diagram of a wearable electronic device coupled to a band incorporating a passive indicator optically coupled to the wearable electronic device. In the embodiment depicted in FIG. 2B, the passive indicator 208*b* optically couples to a light emitter 224 within the wearable electronic device 200.

The passive indicator 208*b* depicted in FIG. 2B includes a light diffusing area 226 to receive and diffuse the light from the light emitter 224. For example, the light diffusing area 226 can include one or more fiber optic cables that each terminates with a diffusive area disposed in or adjacent to a surface (e.g., top surface, sidewall surface) of the second band portion 206. In these cases, each of the one or more fiber optic cables can be associated with a separate light emitter 224, although such a configuration is not required of all embodiments. In other cases, a single light emitter 224 can be coupled to a single light diffusing area that is partitioned into several discrete subareas. As the brightness of the single light emitter 224 increases, sequential partitions of the single light diffusing area are illuminated.

In some cases, the light emitter 224 of FIG. 2B is positioned within a sidewall channel of the housing of the wearable electronic device 200. In some cases, the channel receives and retains an end portion of the band, such as shown, generally, in FIGS. 6A-6B.

In other embodiments, the processor 210 of the wearable electronic device shown in FIGS. 2A-2C serves as a power source for an indicator. For example, FIG. 2C depicts a simplified system diagram of another wearable electronic device coupled to a band incorporating an indicator 208*c* that is powered by the wearable electronic device 200. The indicator 208*c* receives power from the wearable electronic device via a power coupling 228. The power coupling 228 can be any suitable coupling capable of transferring power. In one example, the power coupling 228 includes one or more electrical contacts. In some cases, the housing 202 of the wearable electronic device can serve as one or more electrical contacts. In other cases, the power coupling 228 is a wireless power coupling such as an inductive power transfer system or a magnetic resonance power transfer system. In other cases, the power coupling 228 is a portion of the communication module 214 (shown in FIG. 2A), such as a Near-Field Communication power transfer system.

In some cases, the power coupling 228 can be used by the processor 210 to send data to the indicator 208*c*. In these cases, the power coupling 228 provides both power and instructions to the indicator 208*c*.

In other cases, the processor 210 can modify the output of the power coupling 228 in order to change the data conveyed by the indicator 208*c*. For example, in one embodiment, the indicator 208*c* can be an array of independently addressable light-emitting diodes directly connected to the power coupling. In this example, the processor 210 modifies the current output by the power coupling 228 to control the brightness of the light-emitting diodes.

Figure 3:
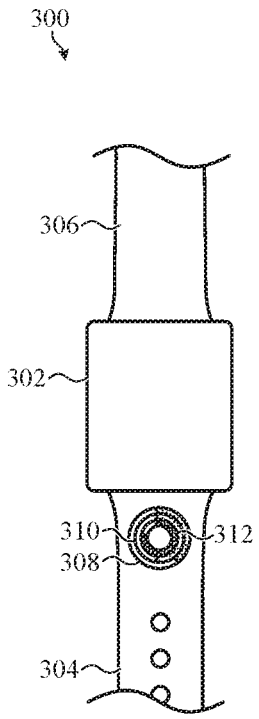
FIG. 3 depicts a wearable electronic device coupled to a band incorporating an indicator including a number of independently and variably and/or progressively illuminable concentric rings.
Figure 4:
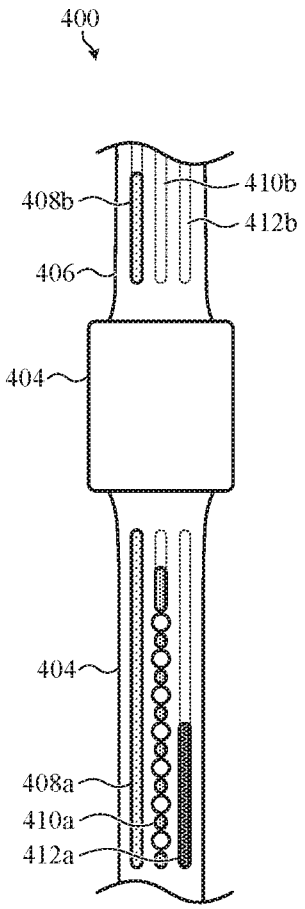
FIG. 4 depicts another wearable electronic device coupled to a band incorporating an indicator including a number of independently and variably and/or progressively illuminable parallel tracks.

FIGS. 3-4 generally depict example embodiments of a wearable electronic device (such as the wearable electronic device 100 depicted in FIGS. 1A-1B) coupled to a band incorporating indicator groups. These embodiments are example distributions of multiple indicators embedded within a band that couples a wearable electronic device to a user. It is understood that the embodiments that follow, and modifications thereof, can each be used in any suitable implementation-specific manner to notify, update, advise, recommend, or otherwise convey information to a user of the wearable electronic device, whether such information specifically relates or derives from external data, motion data, power data, environmental data, physiological data, health data, utility data, and/or other data.

For example, FIG. 3 depicts a wearable electronic device coupled to a band incorporating a group of indicators arranged as three variably and/or progressively illuminable concentric rings. The wearable electronic device updates one or more of the indicators of the group to convey new or updated information to the user. In some cases, individual indicators of the group are updated independently, although this is not required.

More specifically, FIG. 3 depicts a wearable electronic device 300 including a housing 302 that carries, encloses, and supports the operational and/or functional components of the wearable electronic device 300. The housing 302 is coupled to a two-part band system that includes a first band portion 304 and a second band portion 306. As noted with respect to other embodiments described herein, the first and second band portions are configured to join with one another to form a closed loop around the wrist of a user, such as shown in FIG. 1A.

An indicator group is included within the first band portion 304. The indicator group is arranged as three concentric rings, identified as the outer indicator 308, the middle indicator 310, and the inner indicator 312. One or more of the indicators 308, 310, 312 of the indicator group can be self-powered such as the indicator group as shown in FIG. 2A, passive such as the indicator shown in FIG. 2B, or powered by the wearable electronic device such as the indicator group shown in FIG. 2C.

The indicators of the indicator group can be arranged to abut one another such as illustrated, but such a configuration is not required and the indicators may be spaced apart in other embodiments.

Each of the outer indicator 308, the middle indicator 310, and the inner indicator 312 can be variably and/or progressively illuminable indicators such as described herein. As illustrated, the outer indicator 308 is approximately thirty percent illuminated, the middle indicator 310 is approximately fifty percent illuminated, and the inner indicator 312 is approximately seventy five percent illuminated.

In some cases, the outer indicator 308, the middle indicator 310, and the inner indicator 312 are configured to output different colors, although this is not required. For example, the outer indicator 308 may be illuminated red, the middle indicator 310 may be illuminated green, and the inner indicator 312 may be illuminated blue. In other cases, the outer indicator 308, the middle indicator 310, and the inner indicator 312 can be illuminated with the same color at different times. As one example of such an illumination state change, the wearable electronic device can cycle illumination of the indicators, activating the outer indicator 308 first and for a period of time, activating the middle indicator 310 second and for a period of time, and activating the inner indicator 312 last and for a period of time. In other cases, the wearable electronic device illuminates the outer indicator 308, the middle indicator 310, and the inner indicator 312 in a different manner. In other cases, the wearable electronic device can pulse and/or flash one or more of indicators to draw the user's attention to it. In one example, the wearable electronic device brightly illuminates the outer indicator 308 while dimly illuminating the middle indicator 310 and the inner indicator 312.

In typical embodiments, each of the outer indicator 308, the middle indicator 310, and the inner indicator 312 may be configured to convey different types of information to a user of the wearable electronic device. In one embodiment, the outer indicator 308 is configured to convey cumulative daily motion data (e.g., steps in a day), the middle indicator 310 is configured to convey cumulative daily physiological data (e.g., number of minutes in the day with an elevated heart-rate), and the inner indicator 312 is configured to convey cumulative daily health data (e.g., number of hours in which the user stood).

In another embodiment, the outer indicator 308 is configured to convey sleep quality data, the middle indicator 310 is configured to convey time remaining until an upcoming meeting, and the inner indicator 312 is configured to convey the present audio volume output by the wearable electronic device 300.

In another embodiment, different band portions of the wearable electronic device 300 can convey different information. In another embodiment, one or more indicators of the wearable electronic device 300 can periodically cycle through different modes or stages; in a first mode the indicator may convey health data and in a second mode the indicator may convey calendar information. In these examples, the wearable electronic device 300 can cycle through the several modes of a particular indicator at any suitable rate (e.g., regular intervals) to facilitate the user's understanding of the information meant to be conveyed. In other examples, the wearable electronic device 300 can cycle through the several modes of a particular indicator based on the motion or activity of the user. For example, the wearable electronic device 300 can wait to activate an indicator until the wearable electronic device 300 determines that the user has raised the user's wrist. After determining the user's wrist is raised, the wearable electronic device 300 can begin cycling through the various modes of the indicator.

By understanding the unique vocabulary used by a wearable electronic device 300 (e.g., whether defined by the user or not), the user of the wearable electronic device 300 comprehends the user's progress at any point during the day toward the user's daily motion, health, and/or physiological goals.

In some embodiments, the indicator group is illuminated and/or activated only in response to a signal from the wearable electronic device 300 and/or the user. For example, one or more of the indicators 308, 310, 312 can be illuminated when the wearable electronic device 300 detects that the user has raised his or her wrist. In another example, one or more of the indicators 308, 310, 312 can be illuminated when the user presses a button or a display of the wearable electronic device 300. In another example, one or more of the indicators 308, 310, 312 can be illuminated when the user presses a button associated with the band. In another example one or more of the indicators 308, 310, 312 can be illuminated persistently when the wearable electronic device detects persistent motion, such as when the user is exercising while wearing the device.

In many cases, the wearable electronic device 300 adjusts the brightness of the outer indicator 308, the middle indicator 310, and/or the inner indicator 312 based on an amount of ambient light detected by an ambient light sensor within the wearable electronic device. For example, any or all of the outer indicator 308, the middle indicator 310, and the inner indicator 312 may be illuminated more dimly if the wearable electronic device is worn in a dark environment.

In some cases, the wearable electronic device can change one or more illumination states and/or other parameters of one or more of the outer indicator 308, the middle indicator 310, and the inner indicator 312 based on the data said indicator is meant to convey. For example, in one embodiment, the outer indicator 308 tracks the exercise of a user. In addition to conveying the cumulative motion and exercise data to the user by progressively illuminating the outer indicator 308, the wearable electronic device may also pulse the brightness of the outer indicator 308 at the user's current heart rate, respiration rate, or running pace. By understanding this vocabulary, a user of the wearable electronic device 300 immediately comprehends more than one piece of information by observing a single indicator. In these examples, a single indicator can be used; different colors (and/or other properties) can convey different information to the user. One color of the single indicator can be associated with one activity, while another color of the indicator is associated with a second activity.

In some cases, the indicator group can be operated in one or more modes. For example, when in a marathon race mode, each of the indicators of the group can be associated with communicating information to the user that relates to the user's progress during a long-distance run. In this example, the outer indicator 308 is associated with a remaining distance the user has to traverse, the middle indicator 310 is associated with comparison (e.g., percentage) of the heart rate of the user to a maximum target heart rate, and the inner indicator 312 can be associated with an amount of time remaining before the user should ingest water or electrolytes to mitigate hyponatremia. In this example, the outer indicator 308 can optionally change color to indicate how close the user is to a target split time, the middle indicator 310 can change color to indicate how close the user is to a target heart rate, and/or the inner indicator 312 can change color to indicate the risk of hyponatremia or dehydration. Optionally, the brightness of the outer indicator 308 (or any other indicator or groups of indicators) can be pulsed to indicate a pace to the user, the brightness of the middle indicator 310 can be pulsed with the user's heartbeat, and/or the brightness of the inner indicator 312 can be pulsed to emphasize the risk of hyponatremia or dehydration.

Another example operational mode can be a navigation mode. In this example, the outer indicator 308 is associated with a remaining distance the user has to traverse, the middle indicator 310 is associated with the user's current speed, and the inner indicator 312 can be associated with an amount of time remaining before the next turn required of the user. In this example, the outer indicator 308 can optionally change color to indicate how close the user is to their destination and the middle indicator 310 can change color to whether the user is speeding.

In other cases, an indicator need not represent an analog dial. For example, an interior portion of one or more of the indicators can be moved from one location to another location in to represent, for example, a bubble level or a chase animation.

In other cases, a group of indicators can be arranged in a manner different from that shown in FIG. 3. For example, FIG. 4 depicts a wearable electronic device coupled to a band incorporating a group of indicators arranged as three variably and/or progressively illuminable tracks. As with the embodiment depicted in FIG. 3, the wearable electronic device updates one or more of the indicators of the group to convey new or updated information to the user. In some cases, individual indicators of the group are updated independently, although this is not required.

More specifically, FIG. 4 depicts a wearable electronic device 400 including a housing 402 that carries, encloses, and supports the operational and/or functional components of the wearable electronic device 400. The housing 402 is coupled to a two-part band system that includes a first band portion 404 and a second band portion 406. As noted with respect to other embodiments described herein, the first and second band portions are configured to join with one another to form a closed loop around the wrist of a user, such as shown in FIG. 1A.

An indicator group is included partially within the first band portion 404 and partially within the second band portion 406. The indicator group is arranged as tracks, identified as the left indicator 408, the middle indicator 410, and the right indicator 412. Although the tracks are illustrated as substantially parallel to one another, such a configuration is not required. One or more of the indicators 408, 410, 412 of the indicator group can be self-powered such as the indicator group as shown in FIG. 2A, passive such as the indicator shown in FIG. 2B, or powered by the wearable electronic device such as the indicator group shown in FIG. 2C.

As with the concentric indicators of FIG. 3, each of the left indicator 408, the middle indicator 410, and the right indicator 412 can be variably and/or progressively illuminable indicators such as described herein. Additionally, each indicator may be portioned into at least two distinct components, one component disposed within the first band portion 404 and one component disposed within the second band portion 406. In this manner, when the first and second band portions are joined with one another to form a closed loop around the wrist of a user, the portions of the individual indicators overlap. In this manner, a single, contiguous (or semi-contiguous) indicator can be formed.

More specifically, the left indicator 408 can include a first component 408*a* disposed within the first band portion 404 and a second component 408*b* disposed within the second band portion 406. Similarly, the middle indicator 410 can include a first component 410*a* disposed within the first band portion 404 and a second component 410*b* disposed within the second band portion 406. Similarly, the right indicator 412 can include a first component 412*a* disposed within the first band portion 404 and a second component 412*b* disposed within the second band portion 406.

As illustrated, the left indicator 408 is approximately eighty percent illuminated, the middle indicator 410 is approximately forty percent illuminated, and the right indicator 412 is approximately twenty five percent illuminated.

As with other embodiments described herein, the left indicator 408, the middle indicator 410, and the right indicator 412 can be configured to output different colors, brightness, hue, saturation, and so on, although this is not required.

In typical embodiments, each of the left indicator 408, the middle indicator 410, and the right indicator 412 may be configured to convey different types of information to a user of the wearable electronic device. In one embodiment, the left indicator 408 is configured to convey cumulative daily task data (e.g., tasks completed in a day), the middle indicator 410 is configured to convey cumulative daily working hours, and the right indicator 412 is configured to convey cumulative unread email. By understanding this vocabulary, the user of the wearable electronic device 400 immediately comprehends the user's progress at any point during the day toward the user's daily task completion and work goals.

FIGS. 5A-5E generally depict example embodiments of a wearable electronic device (such as the wearable electronic device 100 depicted in FIGS. 1A-1B) coupled to a band incorporating indicators or indicator groups within a top surface of a band. These embodiments are example distributions of multiple indicators embedded within a top surface of a band that couples a wearable electronic device to a user. As with other embodiments described herein, it is understood that the embodiments that follow, and modifications thereof, can each be used in any suitable implementation-specific manner to notify, update, advise, recommend, or otherwise convey information to a user of the wearable electronic device, whether such information specifically relates to or derives from external data, motion data, power data, environmental data, physiological data, health data, utility data, and/or other data. Further, one may appreciate that the embodiments that follow are merely examples and that other types or topologies of indicators or groups of indicators are contemplated.

Figure 5A:
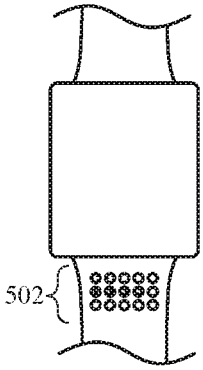
FIG. 5A depicts another wearable electronic device coupled to a band incorporating an indicator including a grid of independently illuminable areas.

For example, FIG. 5A depicts a wearable electronic device coupled to a band incorporating an indicator group 502 including a grid of independently illuminable areas in a top surface of the band. The wearable electronic device updates one or more of the indicators of the group to convey new or updated information to the user. In some cases, individual indicators of the group are updated independently, although this is not required. The indicator group 502 can be embedded within, extend proud of, or can be flush with the top surface of the band.

Figure 5B:
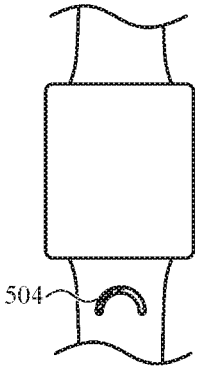
FIG. 5B depicts another wearable electronic device coupled to a band incorporating an indicator including an arcuate progress dial.

FIG. 5B depicts a wearable electronic device coupled to a band incorporating an indicator including an arcuate progress dial 504 in a top surface of the band. The wearable electronic device updates the angular position of the progress dial to convey completion information or progress information to a user of the wearable electronic device. The arcuate progress dial 504 can be embedded within, extend proud of, or can be flush with the top surface of the band.

Figure 5C:
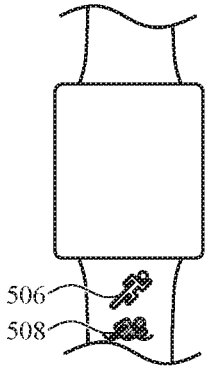
FIG. 5C depicts another wearable electronic device coupled to a band incorporating an indicator including a number of independently illuminable icons.

FIG. 5C depicts a wearable electronic device coupled to a band incorporating an indicator including a number of independently illuminable icons in a top surface of the band. The independently illuminable icons can be configured to represent any number of graphics. For example, as illustrated, a running icon 506, when illuminated, can indicate that the wearable electronic device has entered a mode configured to collect health data, motion data, and/or physiological data while the user is running. Separately, a swimming icon 508, when illuminated, can indicate that the wearable electronic device has entered a mode configured to collect health data, motion data, and/or physiological data while the user is swimming. In other cases, other icons can be used. In some embodiments, an icon can be animated. The icons can be embedded within, extend proud of, or can be flush with the top surface of the band.

Figure 5D:
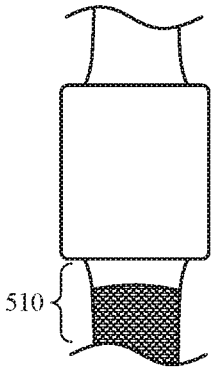
FIG. 5D depicts another wearable electronic device coupled to a band configured to operate as an indicator.

FIG. 5D depicts a wearable electronic device coupled to a band 510 configured to operate as an indicator. In this embodiment, the top surface of the band itself is formed from a variably and/or progressively illuminable or colorable material, such as an electronic ink.

Figure 5E:
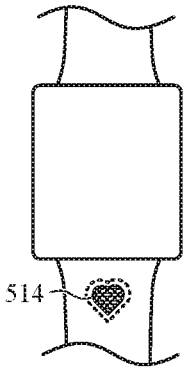
FIG. 5E depicts another wearable electronic device coupled to a band incorporating an indicator including a variably and/or progressively illuminable icon.

FIG. 5E depicts a wearable electronic device coupled to a band incorporating an indicator including a variably and/or progressively illuminable icon 514. Similar to the embodiment depicted in FIG. 5C, a variably and/or progressively illuminable icon 514 can change in size or shape to convey different or new information to a user. For example, as illustrated, the variably and/or progressively illuminable icon 514 takes the shape of a stylized heart; in one embodiment the size of the icon as it appears to a user increases or decreases to convey information (such as heart rate) to the user. In another embodiment, the icon may variably illuminate, for example to mimic or model a heartbeat. The variably and/or progressively illuminable icon 514 can be embedded within, extend proud of, or can be flush with the top surface of the band.

Figure 6A:
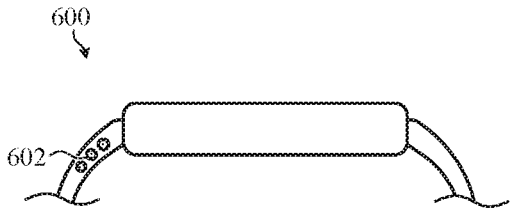
FIG. 6A depicts another wearable electronic device coupled to a band incorporating yet another indicator.
Figure 6B:
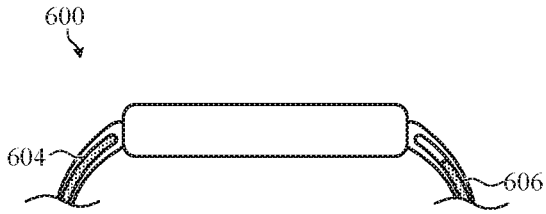
FIG. 6B depicts another wearable electronic device coupled to a band incorporating yet another indicator.

FIGS. 6A-6B generally depict example embodiments of a wearable electronic device (such as the wearable electronic device 100 depicted in FIGS. 1A-1B) coupled to a band incorporating indicators or indicator groups within a side surface of a band. These embodiments are example distributions of multiple indicators embedded within a side or sidewall surface of a band that couples a wearable electronic device to a user. As with other embodiments described herein, it is understood that the embodiments that follow, and modifications thereof, can each be used in any suitable implementation-specific manner to notify, update, advise, recommend, or otherwise convey information to a user of the wearable electronic device, whether such information specifically relates or derives from external data, motion data, power data, environmental data, physiological data, health data, utility data, and/or other data. Further one may appreciate that the embodiments that follow are merely examples and that other types or topologies of indicators or groups of indicators are contemplated.

For example, FIG. 6A depicts a wearable electronic device coupled to a band incorporating an indicator group 602 including a grid of independently illuminable areas in a side surface of the band. The side surface of the band incorporating the indicator can be a side surface closest to the user's body and/or a side surface closest to a user's hand. The wearable electronic device updates one or more of the indicators of the group to convey new or updated information to the user. In some cases, individual indicators of the group are updated independently, although this is not required. The indicator group 602 can be embedded within, extend proud of, or can be flush with the side surface of the band.

FIG. 6B depicts a wearable electronic device coupled to a band incorporating an indicator track 604 in a side surface of the band. The side surface of the band incorporating the indicator can be a side surface closest to the user's body and/or a side surface closest to a user's hand. The wearable electronic device updates the portion of the track that is illuminated to convey new or updated information to the user. In some cases, individual indicators of the group are updated independently, although this is not required. The indicator track 604 can be embedded within, extend proud of, or can be flush with the side surface of the band.

Figure 7A:
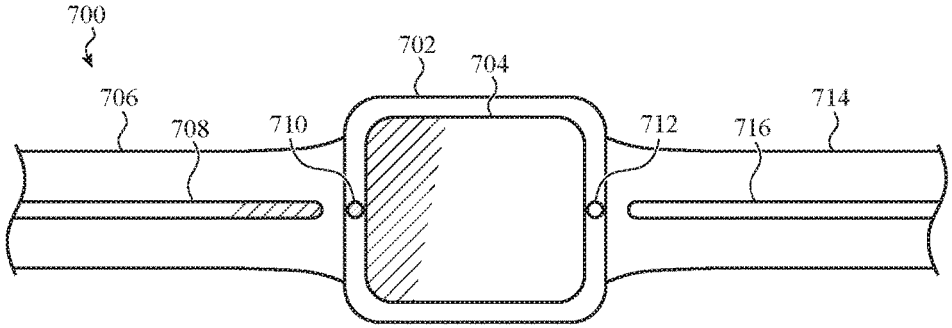
FIG. 7A depicts another wearable electronic device coupled to a band incorporating an indicator and interacting with a display of the wearable electronic device.
Figure 7B:
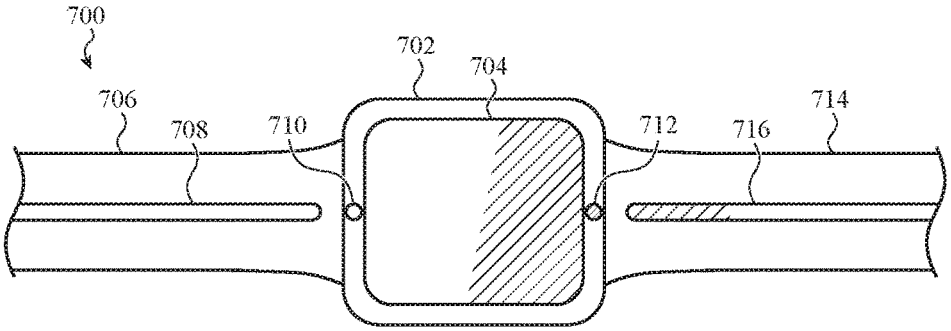
FIG. 7B depicts another wearable electronic device coupled to a band incorporating an indicator and interacting with a display of the wearable electronic device.
Figure 7C:
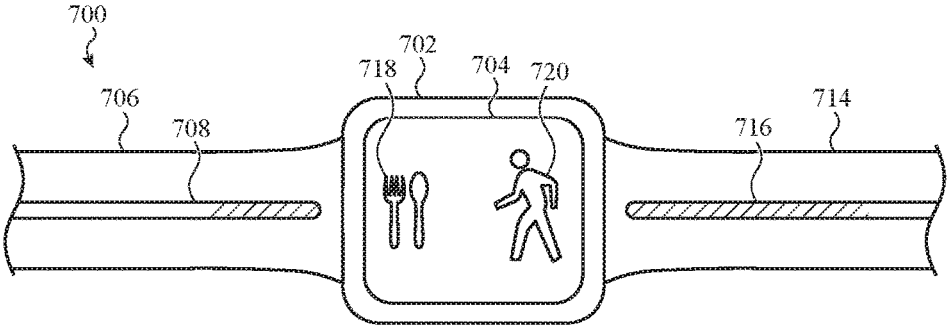
FIG. 7C depicts another wearable electronic device coupled to a band incorporating an indicator and interacting with a display of the wearable electronic device.

FIGS. 7A-7C generally depict example embodiments of a wearable electronic device (such as the wearable electronic device 100 depicted in FIGS. 1A-1B) coupled to a first band and second band in a two-band attachment system, each band incorporating one or more indicators within a top surface of a band. These embodiments include indicators embedded within a top surface of a band configured to interact with a display of a coupled wearable electronic device. As with other embodiments described herein, it is understood that the embodiments that follow, and modifications thereof, can each be used in any suitable implementation-specific manner to notify, update, advise, recommend, or otherwise convey information to a user of the wearable electronic device, whether such information specifically relates to or derives from external data, motion data, power data, environmental data, physiological data, health data, utility data, and/or other data. Further, one may appreciate that the embodiments that follow are merely examples and that other types or topologies of indicators or groups of indicators are contemplated.

For example, FIGS. 7A and 7B depict a wearable electronic device 702 coupled to a first band 706 incorporating an indicator 708 and a second band 714 incorporating an indicator 716. The indicator 708 in the first band 706 and the indicator 716 in the second band 714 are arranged as variably and/or progressively illuminable tracks. The wearable electronic device includes a display 704, and updates one or more of the indicators 708, 716 and/or the display 704 to convey new or updated information to the user. In some cases, the indicators 708, 716 are updated independently, although this is not required. The indicators 708, 716 can be embedded within, extend proud of, or can be flush with the top surface of the bands 706, 714.

The indicators 708, 716 may be operated in conjunction with the display 704. For example, as depicted in FIG. 7A, a segment of the indicator 708 in the first band 706 may be illuminated, and the indicator 708 may be illuminated in a manner to appear that the illuminated segment is traveling across the first band 706. As the traveling illuminated segment reaches the end of the indicator 708, a portion of the display 704 may be similarly illuminated, to give the appearance that the illuminated segment travels across the display 704. As the illuminated portion travels to an opposite end of the display 704, a segment of the indicator 716 in the second band 714 may be illuminated such that the segment appears to continue travelling, as depicted in FIG. 7B.

In some embodiments, the interaction of the indicators 708, 716 and the display 704 may be enhanced by placing one or more additional indicators 710, 712 on or in the housing of the wearable electronic device 702. These housing indicators 710, 712 may be formed by a suitable method, such as by forming an opening in the housing which may reveal an underlying light source. The housing indicators 710, 712 may be operated in conjunction with the band indicators 708, 716 and the display 704. Returning to the example of the traveling illuminated segment, an illuminated segment may travel across the indicator 708 in the first band, through the adjacent indicator 710 in the housing, and to the display 704, as depicted in FIG. 7A. The illuminated segment may continue to travel across the display 704, through an indicator 710 in the housing adjacent the second band 714, and to the indicator 716 in the second band, as depicted in FIG. 7B.

FIGS. 7A and 7B are discussed above with reference to a light segment traveling through the indicator 708 in the first band 706, the display 704, housing indicators 710, 712, and through the indicator 716 in the second band 714. It should be understood that the display 704 and indicators may interact in other ways. For example, the first band 706, wearable electronic device 702, and second band 714 may be operated as a continuous or near-continuous progressive or variable indicator. In other examples, the indicator 708 in the first band 706 and the indicator 716 in the second band 714 may be operated independently, one or both bands 706, 714 may incorporate additional indicators that interact with the display 704 and/or housing indicators 710, 712, and so on.

In another example embodiment, FIG. 7C depicts a wearable electronic device 702 coupled to a first band 706 incorporating an indicator 708 and a second band 714 incorporating an indicator 716. The indicator 708 in the first band 706 and the indicator 716 in the second band 714 are arranged as a variably and/or progressively illuminable track. The wearable electronic device includes a display 704, which may present one or more symbols (or similar indicia) 718, 720 related to the indicators 708, 716. For example, the indicator 708 in the first band 706 may be progressively illuminated to indicate tracked data. A symbol 718 may appear on a side of the display 704 adjacent the first band 706, indicating the type of data being tracked in the indicator 708. In the illustrated example, a food symbol 718 indicates that caloric intake is being tracked in the indicator 708.

Another symbol 720 may appear on another side of the display 704 adjacent the second band 714, indicating the type of data being tracked in the indicator 720. In the illustrated example, a walking symbol 720 indicates that steps are being tracked in the indicator 726. In other embodiments, different symbols 718, 720 may be employed to indicate various types of data being tracked. In many examples, various data may be tracked and may automatically or selectively be represented using the same indicators 708, 718, with the symbols 718, 720 changing to indicate the type of data represented.

Figure 8:
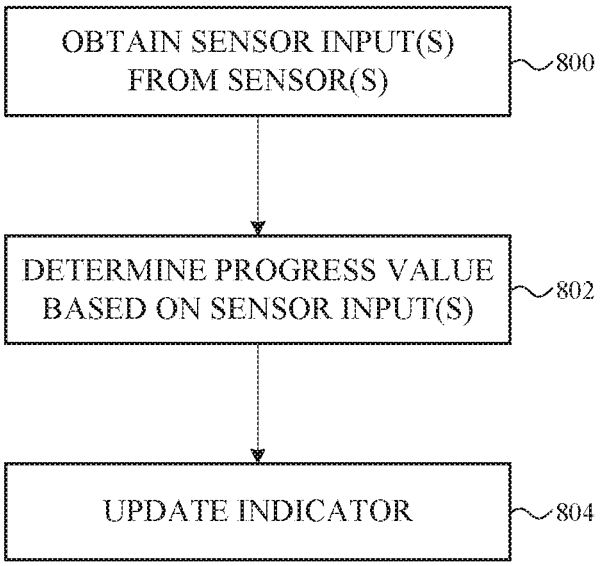
FIG. 8 depicts operations of a method of updating an indicator.

FIG. 8 depicts operations of a method of updating an indicator of a wearable electronic device. In many embodiments, the method depicted in FIG. 8 can be performed, at least in part, by a processor within a wearable electronic device such as the processor 210 as shown in FIGS. 2A-2C.

The method begins at operation 800 in which sensor inputs are obtained from a sensor. Sensor input can relate to, but is not limited to, external data, motion data, power data, environmental data, physiological data, health data, and/or utility data. At operation 802, a progress value is computed based on an aggregation of the sensor inputs. In one example, sensor inputs can be aggregated over time. In other cases, sensor inputs from more than one sensor can be aggregated or combined together. For example, data from a gyroscope and an accelerometer can be combined and/or aggregated to yield an aggregate motion progress value.

The aggregation of the sensor inputs over time, the rate of change of the sensor inputs, the average of the sensor inputs, the maximum of the sensor inputs, the minimum of the sensor inputs, the standard deviation of the sensor inputs, and so on, can all be used to adjust or calculate a progress value. In some cases, the progress value can be calculated based on sensor inputs obtained from more than one sensor. Lastly, at operation 804, the progress value is used to update one or more indicators associated with the wearable electronic device.

One may appreciate that although many embodiments are disclosed above, that the operations and steps presented with respect to methods and techniques described herein are meant as exemplary and accordingly are not exhaustive. One may further appreciate that an alternate step order or fewer or additional steps may be implemented in particular embodiments.

Furthermore, the present disclosure recognizes that personal information data, including biometric data, in the present technology, can be used to the benefit of users. For example, the use of biometric authentication data can be used for convenient access to device features without the use of passwords. In other examples, user biometric data is collected for providing users with feedback about their health or fitness levels. Other uses for personal information data, including biometric data that benefit the user are also contemplated by the present disclosure.

The present disclosure further contemplates that the entities responsible for the collection, analysis, disclosure, transfer, storage, or other use of such personal information data will comply with well-established privacy policies and/or privacy practices. In particular, such entities should implement and consistently use privacy policies and practices that are generally recognized as meeting or exceeding industry or governmental requirements for maintaining personal information data private and secure, including the use of data encryption and security methods that meets or exceeds industry or government standards.

For example, personal information from users should be collected for legitimate and reasonable uses of the entity and not shared or sold outside of those legitimate uses. Further, such collection should occur only after receiving the informed consent of the users. Additionally, such entities would take any needed steps for safeguarding and securing access to such personal information data and ensuring that others with access to the personal information data adhere to their privacy policies and procedures. Further, such entities can subject themselves to evaluation by third parties to certify their adherence to widely accepted privacy policies and practices.

Despite the foregoing, the present disclosure also contemplates embodiments in which users selectively block the use of, or access to, personal information data, including biometric data. That is, the present disclosure contemplates that hardware and/or software elements can be provided to prevent or block access to such personal information data. For example, in the case of biometric authentication methods, the present technology can be configured to allow users to optionally bypass biometric authentication steps by providing secure information such as passwords, personal identification numbers, touch gestures, or other authentication methods, alone or in combination, known to those of skill in the art. In another example, users can opt to remove, disable, or restrict access to certain health-related applications collecting users' personal health or fitness data.

We claim:

1. A watch comprising:
- a housing;
- a processor within the housing, the processor being configured to:
  - track multiple types of data associated with a wearer during operation of the watch; and
  - calculate a progress value based on one of the multiple types of data being tracked by the processor;
- a band releasably attached to the housing and comprising an indicator operable to show a progressively illuminated region based on the progress value; and
- a display within the housing, the display being configured to show a symbol indicating which one of the multiple types of data corresponds to the progressively illuminated region shown on the indicator of the band.

2. The watch of claim 1, further comprising a sensor, and the processor is configured to track the data based on operation of the sensor.

3. The watch of claim 2, wherein the sensor is an ambient light sensor, a proximity sensor, a temperature sensor, a barometric pressure sensor, and/or a moisture sensor.

4. The watch of claim 2, wherein the sensor is an accelerometer, a gyroscope, a global positioning sensor, and/or a tilt sensor.

5. The watch of claim 2, wherein the sensor is a heart rate sensor, a respiration rate sensor, a blood oxygenation level sensor, a blood volume estimate sensor, a blood pressure sensor, and/or an arterial pressure sensor.

6. The watch of claim 2, wherein the sensor is a magnetic field sensor, an electric field sensor, a color meter, an acoustic impedance sensor, a pH level sensor, and/or a material detection sensor.

7. The watch of claim 1, wherein the data comprises biometric data of a user.

8. The watch of claim 1, wherein the data comprises caloric intake of a user.

9. The watch of claim 1, wherein the data comprises steps taken by a user.

10. The watch of claim 1, wherein:
- the symbol is a first symbol;
- the data is first data;
- the indicator is a first indicator;
- the progressively illuminated region is a first progressively illuminated region;
- the processor is further configured to track second data during operation of the watch;
- the display is further configured to show a second symbol corresponding to the second data; and
- the band comprises a second indicator operable to show a second progressively illuminated region corresponding to the second data.

11. A watch comprising:
- a housing comprising a display;
- a band releasably attached to the housing and comprising a first indicator on a first side of the display and a second indicator on a second side of the display; and
- a processor configured to:
  - control the display to show a first symbol adjacent to the first indicator and corresponding to a first type of data;
  - control the first indicator to show a first illuminated segment corresponding to the first type of data;
  - control the display to show a second symbol adjacent to the second indicator and corresponding to a second type of data; and
  - control the second indicator to show a second illuminated segment corresponding to the second type of data.

12. The watch of claim 11, further comprising a sensor configured to produce an output corresponding to the first type of data and/or the second type of data.

13. The watch of claim 11, wherein the first indicator and the second indicator are each along a corresponding progressively illuminable region extending along the band.

14. The watch of claim 11, wherein the first symbol indicates caloric intake being tracked in the first indicator.

15. The watch of claim 11, wherein the second symbol indicates that steps are being tracked in the second indicator.

16. A watch comprising:
- a housing comprising a display configured to show a first symbol on a first side of the display and corresponding to a first type of data and a second symbol on a second side of the display corresponding to a second type of data;

a first band portion releasably attached to a first side of the housing and comprising a first indicator operable to show a first illuminated region corresponding to the first type of data; and a second band portion releasably attached to a second side of the housing and comprising a second indicator operable to show a second illuminated region corresponding to the second type of data.

17. The watch of claim 16, further comprising a sensor configured to produce an output corresponding to the first type of data and/or the second type of data.

18. The watch of claim 16, wherein the first indicator and the second indicator are each along a corresponding progressively illuminable region extending along the first band portion and/or the second band portion.

19. The watch of claim 16, wherein the first symbol indicates caloric intake being tracked in the first indicator.

20. The watch of claim 16, wherein the second symbol indicates that steps are being tracked in the second indicator.

* * * * *